US006645393B2

(12) United States Patent
Lee

(10) Patent No.: US 6,645,393 B2
(45) Date of Patent: Nov. 11, 2003

(54) MATERIAL COMPOSITIONS FOR TRANSIENT VOLTAGE SUPPRESSORS

(75) Inventor: Chun-yuan Lee, Hsin-Chu (TW)

(73) Assignee: Inpaq Technology Co., Ltd., Taipei Hsien (TW)

( * ) Notice: Subject to any disclaimer, the term of this patent is extended or adjusted under 35 U.S.C. 154(b) by 40 days.

(21) Appl. No.: 09/810,183

(22) Filed: Mar. 19, 2001

(65) Prior Publication Data

US 2002/0130301 A1 Sep. 19, 2002

(51) Int. Cl.[7] ..... H01C 7/10; H01B 1/06

(52) U.S. Cl. ..... 252/62.32 B; 252/62.3; 252/62.3 C; 252/519.5; 252/519.51; 252/519.52; 252/520.21; 252/338; 252/20; 252/21; 252/225 D; 252/428; 252/403; 252/688; 252/689; 252/427; 252/101; 252/361

(58) Field of Search ..... 252/502, 503, 252/504, 512, 513, 514, 515, 516, 518, 62.3 B, 62.3 C, 62.3; 338/20, 21, 22 SD; 361/126, 127; 427/101; 428/403, 688, 689

(56) References Cited

U.S. PATENT DOCUMENTS 4,798,694 A * 1/1989 Sugata et al. ..... 338/22 R
5,068,634 A * 11/1991 Shrier ..... 252/512
6,157,290 A * 12/2000 Glatz-Reichenbach et al. .. 338/22 R
6,469,611 B1 * 10/2002 Kluge-Weiss et al. ..... 338/20

FOREIGN PATENT DOCUMENTS

DE 19800470 A * 7/1999 ..... H01C/7/02
JP 02-241003 * 9/1990 ..... H01C/7/10

* cited by examiner

*Primary Examiner*—Yogendra N. Gupta
*Assistant Examiner*—Kallambella Vijayakumar
(74) *Attorney, Agent, or Firm*—Troxell Law Office PLLC

(57) ABSTRACT

The material for transient voltage suppressors is composed of at least two kinds of evenly-mixed powders including a powder material with non-linear resistance interfaces and a conductive powder. The conductive powder is distributed in the powder with non-linear resistance interfaces to relatively reduce the total number of non-linear resistance interfaces between two electrodes and, as a result, decrease the breakdown voltage of the components.

8 Claims, 4 Drawing Sheets

MATERIAL COMPOSITIONS FOR TRANSIENT VOLTAGE SUPPRESSORS

BACKGROUND OF INVENTION

Description of Conventional Techniques

The material and structure of conventional varistor made from zinc oxide are composed of oxides, such as B, Bi, Ba, Si, Sr, Pb, Pr, Co, Mn, Sb or Cr or their mixtures. The oxide, such as bismuth oxide, forms a crystal boundary between the particles of zinc oxide and the density of this material shall be maintained close to the theoretical density structure, usually more than 90% of the theoretical density. The material is a commercialized product, but its capacitance value is too high. The crystal layer is similar to capacitors in the performance of electrical property and brings a high capacitance value to the varistor made from it so that these varistors are not suitable for RF circuits. This is the major disadvantage of this kind of varistor. The aforesaid material for the transient voltage suppressors in said invention has a loosely stacked structure and, therefore, can provide a lower capacitance value and leakage current even using the same material ingredients and component designs. It is, therefore, suitable for the use in RF circuits and antennas.

The breakdown voltage of varistor made from zinc oxide is related to the number of crystal boundary between the two electrodes. There is a crystal boundary between the crystals of zinc oxide. This is a non-linear resistance interface between zinc oxide crystal. Assuming that N stands for the semiconductor made from zinc oxide and P stands for the crystal boundary, the structure of varistor from one end of the electrode to the other end may be described as:

E-P-N-P-N- . . . -N-P-N-P-E

Wherein E stands for the electrodes of the conductor. A breakdown voltage Vb1 exists for each P-N interface. Assuming that there are several P-N interfaces between the electrodes, the breakdown voltage Vb may be described as the sum of Vb1.

The invention that is still under patent application is a kind of loosely stacked material with non-linear resistance interfaces. Taking the powder with non-linear resistance interface composed of oxides, such as B, Bi, Ba, Si, Sr, Pb, Pr, Co. Mn, Sb or Cr, or their mixture sintered with zinc oxide powder as an example. There are some powders with non-linear resistance interface between the two electrodes of the component. Assuming that P stands for composed of oxides, such as B, Bi, Ba, Si, Sr, Pb, Pr, Co., Mn, Sb or Cr, or their mixture and N stands for zinc oxide powder. The structure of the invented transient voltage protection components from one end of the electrode to the other end may be described as:

E-P-N-P-S-P-N-P- . . . -P-N-P-S-P-N-P-E

Wherein P-N-P stands for a crystal, while S stands for the space layer between crystals. S can be an insulator of air or glass and the breakdown voltage therein is represented by Vs. S may also not exist due to the contact of crystals. Breakdown voltage Vb2 exists for each P-N-P. Because there are a number of crystals between the electrodes, the breakdown voltage of the components may be described as the sum of Vb2 plus the sum of Vs.

The material for voltage suppressors that was published in U.S. Pat. No. 4,726,991 was composed of a conductor or semiconductor powder coated with an insulating layer with a thickness less than several hundreds of angstroms. This structure, however, has some disadvantages in practical use. First, the thickness of the insulating layer is within several hundreds of angstroms and makes the material very difficult to be produced in the manufacturing process. If the coated insulating layer is too thin, the component will short-circuit easily. If the coated insulating layer is slightly thicker, the breakdown voltage will be increased. This is the fault caused by putting insulating layer over the surface of conductor or semiconductor powder.

Another coating material has been published in U.S. Pat. No. 5,294,374 the structure of which is a mixture of a conductive powder coated with an insulating layer and a semiconductor powder without any insulating layer. The thickness of the coated insulating layer is between 70 angstroms and 1 micron. The coating layer can be made from semiconductors. Basically, the coating layer is made from insulating or semiconductor material that can prevent current flow and create high resistance. The thickness of the coating layer directly determines the breakdown voltage of components, therefore, it is important to maintain an even thickness.

All kinds of conductor, semiconductor or insulator powders are uniformly mixed in the variable resistance material containing binder which have been published in US Patent articles with U.S. Pat. Nos. 3,685,026, 3,685,028, 4,977,357, 5,068,634, 5,260,848, 5,294,374, 5,393,596 and 5,807,509 respectively. These powders do not have the characteristics of non-linear resistance in their particle and the action of the breakdown voltage was derived from the composition of these powders, which is different from said invention. The material structure of said invention, therefore, has the characteristics of novelty and practicability.

BRIEF DESCRIPTION OF THE INVENTION

The purpose of said invention is to provide a material for transient voltage suppressors. The material of the invented transient voltage protection material is a mixture of at least two kinds of powders including a powder material with non-linear resistance interfaces and a conductive powder material. The loosely stacked structures of these materials is formed by mixing and sintering these powders uniformly to reduce the total number of non-linear interfaces between the electrodes and, as a result, the breakdown voltage of the components is decreased.

The transient voltage suppressors made from the invented material are applicable to many kinds of component structures. FIG. 1 shows the practical example of the feasible structure of the invented transient voltage suppressors in which the insulating plate 20 is used as the matrix. The conducting electrodes 22 and 24 are formed t on the plate with the positions of the two electrodes on the same plane and a gap 28 between the two electrodes. A kind of component structure can be produced by filling the invented powder material 26 in the gap and heating it appropriately to make the powder material stack up to be a loose structure.

FIG. 2 shows another practical example of the feasible structure of the invented transient voltage suppressors in which the invented powder material is used as the matrix. After the invented powder material is sintered to be blocks, the electrode 34 is formed on the top of the material, while the other electrode 32 is formed on the bottom of the material. This sandwich component structure forms another structure of the transient voltage suppressors.

As for the detailed structure, application principles, functions and performance of said invention, please refer to the following figures for further understanding.

DETAILED DESCRIPTION OF PREFERRED EMBODIMENTS

Figure 3:
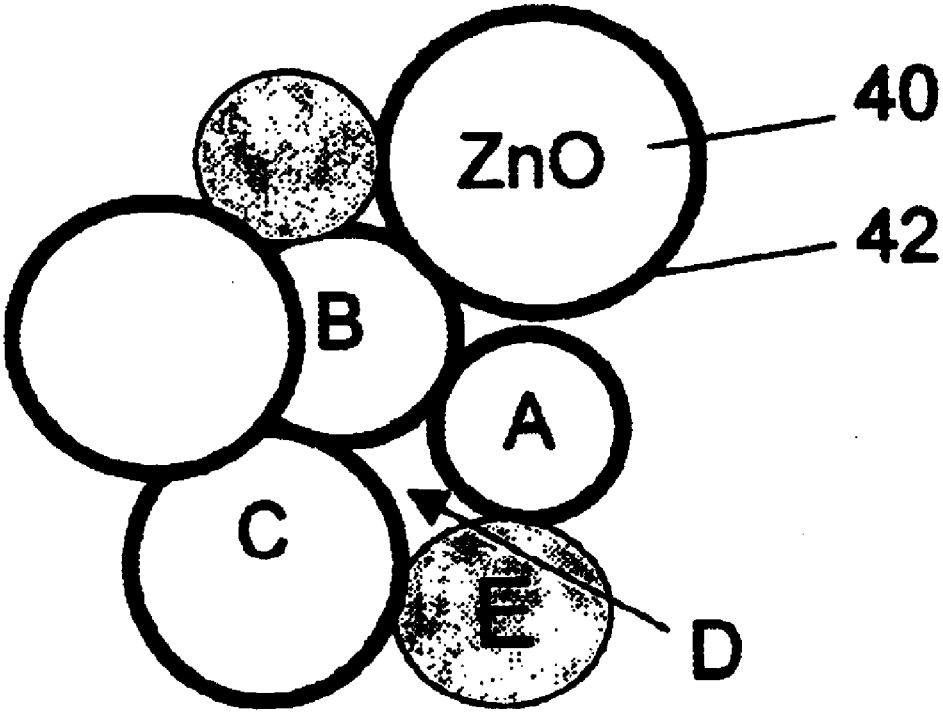
FIG. 3: Microstructure of the invented powder material

FIG. 3 shows the microstructure of the invented powder material with the zinc oxide powder (40). The coating layer 42 is a composed of oxides, such as B, Bi, Ba, Si, Sr, Pb, Pr, Co, Mn, Sb or Cr, or their mixtures. The powder of zinc oxide and its coating layer is called non-linear resistor powder. The structure, therefore, presents a high resistance under normal operation voltage. When surge exists in the circuit, the voltage will increase suddenly. When the increased voltage reaches the breakdown voltage of the material, the material will be breakdown instantly. The material allows strong current to flow through and leads the surge energy to the ground. After the surge energy passes through, the interface will return to the state of the high resistance and the circuit can be protected in this process. The process can be applied repeatedly.

FIG. 3 shows three shorter routs when the powders are breakdown mode that needs to transfer from zinc oxide powder A to zinc oxide powder C. The first route is A-B-C; assuming that P stands for coating layer and N stands for zinc oxide, the route can be represented as N-P-N-P-N and must pass through two PN or NP interfaces no matter what polarity the surge load has. The second route is A-D-C; this route can be represented as N-P-D-P-N and must pass through one PN or NP interface and one space D no matter what polarity the surge load has. These two routes have very high breakdown voltage. The third route is A-E-C wherein E stands for the conductive powder; this route can be represented as N-P-E-P-N. Because E is a conductor, this route passes through only one PN or NP interface no matter what polarity the electrical load has and therefore, has the lowest breakdown voltage among the three routes. Further more, the breakdown voltage value is related to the content of the conductive powder: the higher the content of the conductive powder, the lower the breakdown voltage of the powder. Even if the powder made from zinc oxide is composed of several crystals of zinc oxide, the corresponding situations still apply to the contents described in said invention.

The conductive powder can by metallic or non-metallic conductive powder or semiconductor. The metallic conductive powder is preferably made from the powder of the element Al, Ag, Pd, Pt, Au, Ni, Cu, W, Cr, Fe, Zn, Ti, Nb, Mo, Ru, Pb or Ir. The non-metallic conductive powder is preferably made from graphite powder. The semiconductor is preferably made from metal carbide, such as WC, TiC or NbC etc. The metallic conductive powder can also be made as an alloy powder including one of the elements from the powder Al, Ag, Pd, Pt, Au, Ni, Cu, W, Cr, Fe, Zn, Ti, Nb, Mo, Ru, Pb or Ir.

Figure 4:
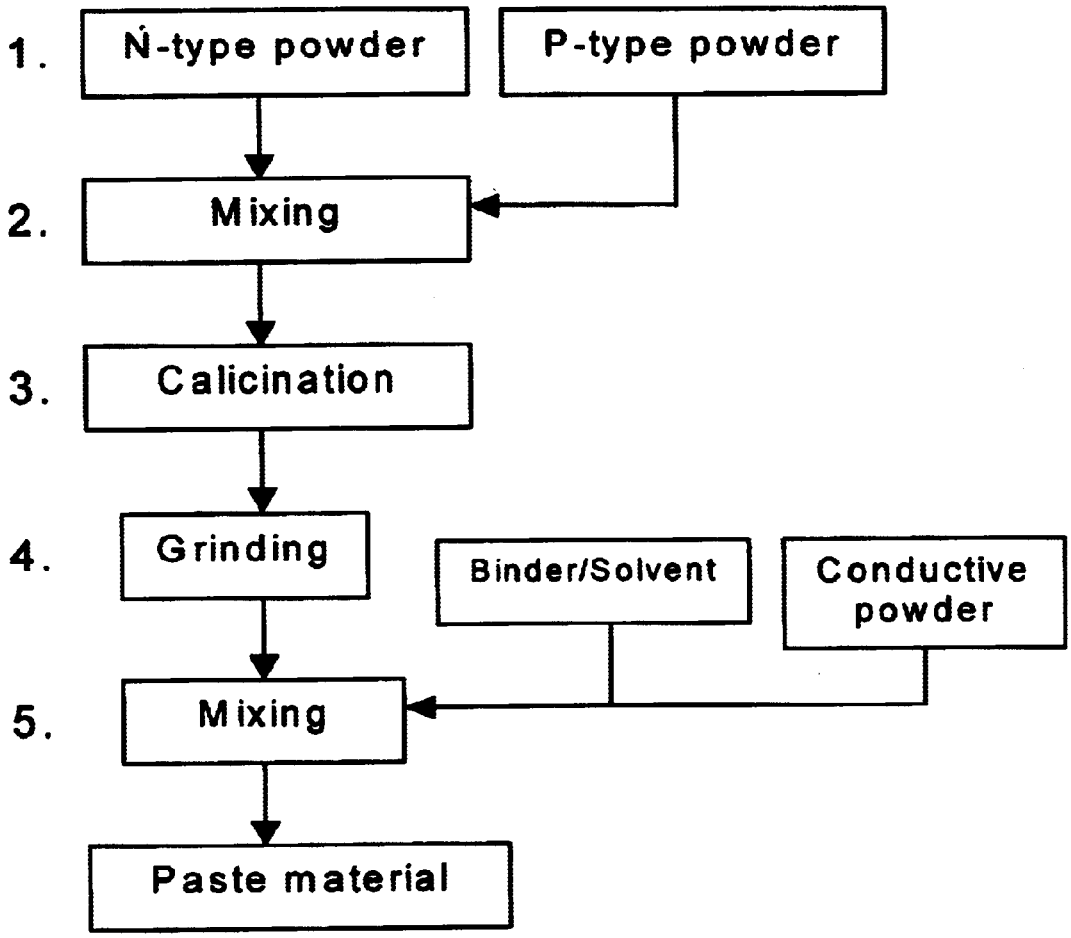
FIG. 4: Manufacturing flow chart of the invented transient voltage suppressors

The manufacturing process of the invented transient voltage protection material is shown in FIG. 4. The steps are described as follows:

Step 1, 2: Mix the zinc oxide powder and the oxides of B, Bi, Ba, Si, Sr, Pb, Pr, Co, Mn, Sb or Cr, or their mixtures uniformly. The applicable average grain diameter of the zinc oxide powder is 0.01–100 $\mu$m, preferable between 0.1–100 $\mu$m. The grain diameter affects the content of the powder between the two electrodes and, consequently, affects the breakdown voltage of the component directly. The weight percentage of the zinc oxide powder is preferably between 50 and 97%. The total weight percentage of oxides of B, Bi, Ba, Si, Sr, Pb, Pr, Co, Mn, Sb or Cr, or their mixture powder is preferably between 3 and 50%.

Step 3: Calcine the powder mixed in Step 1, 2 between 800 to 1600° C. The oxides of B, Bi, Ba, Si, Sr, Pb, Pr, Co, Mn, Sb or Cr, or their mixtures form a liquid phase in the calcination process and form a coating layer on the surface of zinc oxide powder. The interface of coating layer and zinc oxide is a non-linear resistance interface, also known as or Schottky barrier.

Step 4: Grind the material produced in Step 3 to form powder, which still has the characteristics of PN interfaces.

Step 5: Fill conventional binder and/or solvent and conductive powder in the powder material produced in Step 4. A usable paste material can be produced by mixing the conventional binder (such as macromolecular material like ethyl cellulose) and/or solvent (such as organic alcohol, organic ester, and etc) uniformly.

Preferred Embodiment 2

Figure 1A:
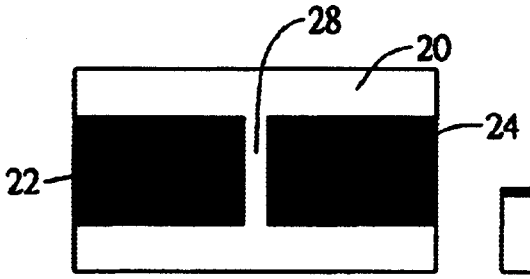
FIGS. 1A–1D: Practical example of the feasible structure of the invented transient voltage of suppressors
Figure 1B:
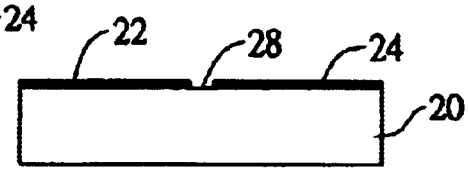
Figure 1C:
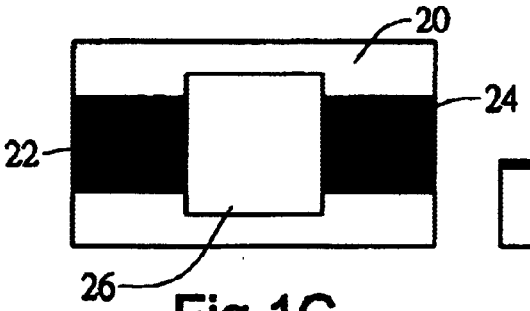
Figure 1D:
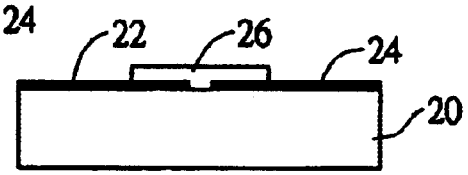
Figure 2:
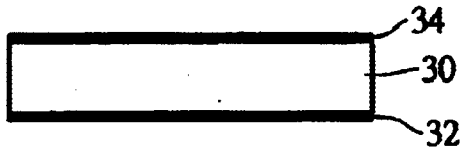
FIG. 2: Another practical example of the feasible structure of the invented transient voltage suppressors
Figure 5:
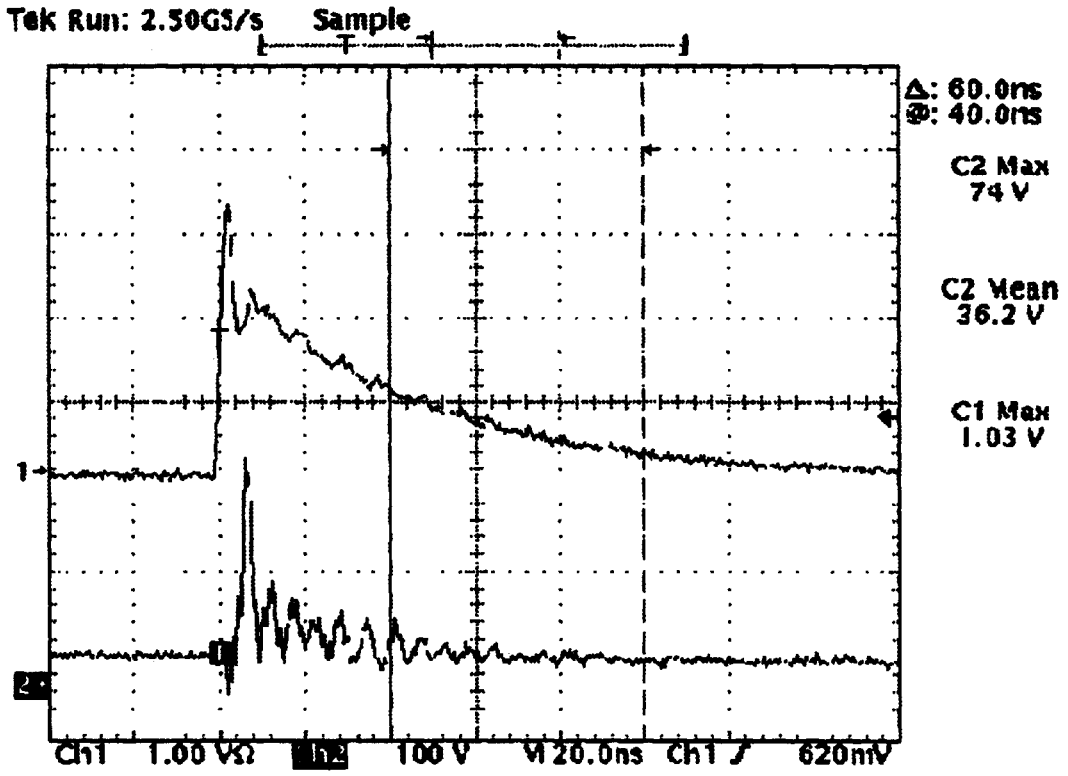
FIG. 5: Electrostatic discharge response curve of said invention

FIG. 5 shows the electrostatic discharge response curve of said invention. Curve 1 represents the response when the current of the electrostatic discharge passes through the component. The source of the electrostatic voltage is 8 kV pulse. The figures show clearly the status of the material after breakdown. A large amount of current is allowed to flow through the component under this circumstance with a maximum current flow of over 30A. The peak voltage is controlled within 300V as shown in the voltage curve in FIG. 2. Which means that the voltage will be reduced to less than 300V when an 8 kV electrostatic discharge passes through the invented component and, as a result the electronic components can be protected.

The transient voltage protection material of said invention has novelty and practicability and, thanks to the structure change of the transient voltage protection material, the transient voltage suppressors has the advantages of stability in manufacturing and properties, low leakage current and low capacitance value. All these features are in conformity with the regulations concerning the application of patents.

It must be stated that the aforesaid examples are the better practical examples of said invention and all the changes that stem from the concept of said invention and the function and effect of which do not exceed the spirit of the specifications and drawings shall be regarded within said invention.

Brief Description of Numerals

20: Insulating plate
22: Conductor electrode
24: Conductor electrode
26: Transient voltage protection material
28: Electrode distance
30: Transient voltage protection material
32: Conductor electrode
34: Conductor electrode
40: Zinc oxide
42: Mixture of bismuth oxide as coating layer
A: Zinc oxide powder B: Zinc oxide powder
C: Zinc oxide powder
D: Gap
E: Conductive powder

What I claim is:

1. A transient voltage protection material to reduce non-linear resistance interfaces between two electrodes and decrease breakdown voltage comprising:

a) a non-linear resistor material having zinc oxide powder having a coating layer, the non-linear resistor material being comprised of zinc oxide powder in an amount between 50 and 97 percent by weight; and b) a conductive powder, the conductive powder being uniformly mixed with the non-linear resistor material.

2. The transient voltage protection material according to claim 1, wherein the zinc oxide powder has granules having a diameter between 0.01 and 100 $\mu$m.

3. The transient voltage protection material according to claim 1, wherein the zinc oxide powder has granules having a diameter between 0.1 and 100 $\mu$m.

4. The transient voltage protection material according to claim 1, wherein the coating material is an oxide of an element selected from a group consisting of B, Bi, Ba, Si, Sr, Pb, Pr, Co, Mn, Sb, and Cr.

5. The transient voltage protection material according to claim 1, wherein the conducting powder is a metallic conductive powder selected from the group of elements consisting of Al, Ag, Pd, Pt, Au, Ni, Cu, W, Cr, Fe, Zn, Ti, Nb, Mo, Ru, Pb, and Ir.

6. The transient voltage protection material according to claim 1, wherein the conducting powder is an alloy powder including at least two elements selected from the group of elements consisting of Al, Ag, Pd, Pt, Au, Ni, Cu, W, Cr, Fe, Zn, Ti, Nb, Mo, Ru, Pb, and Ir.

7. The transient voltage protection material according to claim 1, wherein the conducting powder is a non-metallic conductive powder made from graphite.

8. The transient voltage protection material according to claim 1, wherein the conducting powder is a semiconductor selected from the group consisting of WC, TIC and NbC.

* * * * *